US009993863B2

(12) United States Patent
Fourberg et al.

(10) Patent No.: US 9,993,863 B2
(45) Date of Patent: Jun. 12, 2018

(54) LOW-EMISSION COLD-SETTING BINDER FOR THE FOUNDRY INDUSTRY

(75) Inventors: Christian Fourberg, Mönchengladbach (DE); Gérard Ladégourdie, Düsseldorf (DE); Norbert Benz, Mönchengladbach (DE); Eckard Piech, Bergfeld (DE)

(73) Assignee: HUTTENES-ALBERTUS CHEMISCHE WERKE GMBH, Düsseldorf (DE)

( * ) Notice: Subject to any disclaimer, the term of this patent is extended or adjusted under 35 U.S.C. 154(b) by 387 days.

(21) Appl. No.: 13/984,481

(22) PCT Filed: Dec. 16, 2011

(86) PCT No.: PCT/EP2011/073023

§ 371 (c)(1),
(2), (4) Date: Oct. 11, 2013

(87) PCT Pub. No.: WO2012/080454

PCT Pub. Date: Jun. 21, 2012

(65) Prior Publication Data

US 2014/0048740 A1 Feb. 20, 2014

(30) Foreign Application Priority Data

Dec. 16, 2010 (DE) ..... 10 2010 063 256

(51) Int. Cl.
*B22C 1/22* (2006.01)

(52) U.S. Cl.
CPC ..... *B22C 1/224* (2013.01)

(58) Field of Classification Search
CPC ..... B22C 1/224
See application file for complete search history.

(56) References Cited

U.S. PATENT DOCUMENTS

| | | | | |
|---|---|---|---|---|
| 3,216,075 | A | 11/1965 | Brown | |
| 3,360,492 | A | 12/1967 | Tsou | |
| 3,644,274 | A | 2/1972 | Maurukas | |
| 3,893,964 | A | 7/1975 | Kawai | |
| 3,979,218 | A * | 9/1976 | Hesse et al. | 524/6 |
| 4,176,114 | A | 11/1979 | Stewart et al. | |
| 4,336,342 | A * | 6/1982 | Dunnavant et al. | 523/144 |
| 4,634,723 | A | 1/1987 | Gardziella et al. | |
| 5,491,180 | A | 2/1996 | Kiuchi | |
| 5,741,914 | A | 4/1998 | Everett et al. | |
| 6,391,942 | B1 * | 5/2002 | Chang et al. | 523/144 |
| 2005/0009950 | A1 * | 1/2005 | Dando | 523/139 |
| 2008/0207796 | A1 | 8/2008 | Clingerman | |
| 2011/0073269 | A1 | 3/2011 | Frohn et al. | |

FOREIGN PATENT DOCUMENTS

| | | |
|---|---|---|
| EP | 1531018 | 5/2005 |
| JP | 3174034 | 6/2001 |
| JP | 2010012475 | 1/2010 |

OTHER PUBLICATIONS

Delivery note n. B1 1287 of the Giocaset resin supply, issued on Jun. 9, 2010 by Cavenaghi to carry the Giocaset resin to Fonderian Boccacci s.p.a., via XXV Apr. 9, 19020 Piana Batolla (SP)—Italy.
Invoice N. 1302 of Jun. 11, 2010 for the Giocaset resin supply, issue by Cavenaghi to Fonderia Boccacci s.p.a., wherein the delivery note. B1 1287 is referrred to in the filed "Description of goods."
Delivery note n. B1 1644 of the Giocaset resin supply, issued on Jul. 22, 2010 by Cavenaghi to carry the Giocaset resin to Fonderia Boccacci s.p.a.
Invoice N. 1695 of Jul. 23, 2010 for the Giocaset resin supply, issued by Cavenaghi to Fonderia Boccacci s.p.a., wherein the delivery note n. B1 1644 is referred to in the filed "Description of goods."
Certificate of Analysis n. 513-C relating to the resin KH-Y.
Certificate of Analysis n. 511-C relating to the above-mentioned Giocaset NB 2500 resin.
Third party observation correspondence from Dragotti & Associati to the European Patent Office, dated Dec. 11, 2014.
European Standard, Phenolic, amino and condensation resins—Determination of free-formaldehyde content (ISO 11402:2004), EN ISO 11402, Feb. 2005, 22 pages.
Authorization Letter, "Authorization for reproducing the UNI EN ISO 11402: 2005 standard", Italian National Unification Association, Dated Aug. 4, 2017, 2 pages.
Gardziella et al., Phenolic Resins, Chemistry, Applications, Standardization, Safety and Ecology, 2nd completely revised edition, 7 Chemical, Physical and Application Technology Parameters of Phenolic Resins, 2000, 3 pages.
ECHA, European Chemicals Agency, Substance Information, Hydroxylammonium Chloride, retrieved from the internet on Feb. 8, 2017, 2 pages.
Cavenaghi, "GIOCASET NB 2500 Resin, formaldehyde content analysis", 22 and Aug. 23, 2017, 2 pages.
Decreto Legislativo, English Translation Exceprt From p. 55. www.gazzettaufficiale.it/atto/stampa/serie_generale/ originario, Aug. 23, 2017, p. 55 of 139, 2 pages.
Cavenaghi, "Naming and coding of raw material, packagings and finished products", Operating Instruction O.I. Aug. 1, 2002. Review 4 of the Dec. 6, 2009, 2 pages.
Cavenaghi, Form, "Naming and coding of new products/raw materials", CodiProd.doc—review 3 of the Jan. 30, 2009, 2 pages.
Cavenaghi, Form, "Product Links (for product coding)", legami.doc—review of the Apr. 16, 2010, 2 pages.

* cited by examiner

*Primary Examiner* — Amina S Khan
(74) *Attorney, Agent, or Firm* — Duane Morris LLP; Gregory M. Lefkowitz; Jason M. Nolan

(57) ABSTRACT

The present invention relates primarily to a mixture that is suitable for use in the no-bake process for producing cores and molds for the foundry industry, and a reaction mixture comprising said mixture and an acid hardener (i.e. an acid catalyst). The present invention further relates to a method of producing a mixture according to the invention and a method of producing a mold or a core. The invention also relates to a mold or a core for producing metal objects and a kit comprising a mixture according to the invention and certain acid hardeners. The invention further relates to the use of a mixture according to the invention as cold-setting binder and the use of said mixtures or reaction mixtures in a no-bake process for producing metal objects.

28 Claims, No Drawings

LOW-EMISSION COLD-SETTING BINDER FOR THE FOUNDRY INDUSTRY

CROSS-REFERENCE TO RELATED APPLICATIONS

This application is a § 371 national stage entry of International Application No. PCT/EP2011/073023, filed Dec. 16, 2011, which claims priority to German Patent Application No. 10 2010 063 256.2 filed Dec. 16, 2010, the entire contents of which are incorporated herein by reference.

The present invention relates primarily to a mixture that is suitable for use in the no-bake process for producing cores and moulds for the foundry industry, and a reaction mixture comprising said mixture and an acid hardener (i.e. an acid catalyst). The present invention further relates to a method of producing a mixture according to the invention and a method of production of a mould or a core. The invention also relates to a mould or a core for producing metal objects and a kit comprising a mixture according to the invention and particular acid hardeners. The invention further relates to the use of a mixture according to the invention as cold-setting binder and the use of said mixtures or reaction mixtures in a no-bake process for producing metal objects. Further aspects of the present invention follow from the description, the examples and the claims.

Most products of the iron and steel industry and the non-ferrous metals industry pass through casting processes for initial forming, in which the molten materials, ferrous metals or non-ferrous metals, are transformed into formed objects with particular material properties. For forming the castings it is first necessary to make sometimes very complicated moulds for receiving the molten metal. Moulds are divided into lost moulds, which are destroyed after each casting operation, and permanent moulds, with each of which a large number of castings can be produced. The lost moulds generally consist of a refractory, granular moulding material, which is strengthened by means of a hardenable binder.

Moulds are negatives, they contain the cavity that is to be filled during casting, producing the casting that is to be made. The internal contours of the future casting are formed by cores. During mould production, the cavity is formed in the moulding material by means of a pattern of the casting that is to be made. Internal contours are represented by cores, which are made in a separate core box.

For producing moulds it is possible to use both organic and inorganic binders, which can be hardened by cold or hot processes. Cold processes are processes in which hardening takes place substantially at room temperature without heating the moulding mixture. Hardening then generally takes place by a chemical reaction, which can for example be initiated by passing a gaseous catalyst through the moulding mixture that is to be hardened, or by adding a liquid catalyst to the moulding mixture. In hot processes, after the moulding mixture has been moulded it is heated to a high enough temperature for example to expel the solvent contained in the binder, or to initiate a chemical reaction, by which the binder is hardened by crosslinking.

The production of the moulds can proceed by first mixing the moulding material with the binder, so that the grains of the refractory moulding material become coated with a thin film of the binder. The moulding mixture obtained from moulding base material and binder can then be put in a corresponding moulding box and optionally can be compacted, to provide sufficient stability of the mould. Then the mould is hardened, for example by heating it or by adding a catalyst, which brings about a hardening reaction. If the mould has attained at least a certain initial strength, it can be taken out of the moulding box.

As already mentioned, moulds for producing metal objects are often assembled from so-called cores and moulds. The cores and moulds have to meet different requirements. In the case of moulds, a relatively large surface area is available for carrying away gases that form during casting through the action of the hot metal. For cores, generally only a very small area is available, through which the gases can be carried away. If there is excessive evolution of gas there is therefore a risk of transfer of gas from the core into the molten metal, where it can lead to the formation of casting defects. Therefore the internal cavities are often formed by cores that have been hardened by cold-box binders, i.e. a binder based on polyurethanes, whereas the external contour of the casting is reproduced by more economical moulds, such as a greensand mould, a mould bonded by a furan resin or a phenolic resin, or a steel mould.

For larger moulds, generally organic polymers are used as binder for the refractory, granular moulding material. The refractory, granular moulding material used is often washed and classified quartz sand, but also other moulding materials, for example zircon sands, chromite sands, chamottes, olivine sands, feldspar-containing sands and andalusite sands. The moulding mixture obtained from moulding base material and binder is preferably in a free-flowing form.

At present, organic binders, e.g. polyurethane, furan-resin or epoxy-acrylate binders are often used for mould producing, where hardening of the binder takes place by addition of a catalyst. Phenolic resins (acid hardening or—in the alpha-set process—ester hardening) are also used.

Selection of a suitable binder is based on the shape and size of the casting to be produced, the production conditions and the material used for the casting. Thus, in the production of small castings that are produced in large numbers, often polyurethane binders are used, as these permit quick cycle times and thus also mass production.

Methods in which the moulding mixture is hardened by heat or by later addition of a catalyst have the advantage that the processing of the moulding mixture is not subject to any particular temporal restrictions. The moulding mixture can first be produced in quite large amounts, which are then processed within quite a long period, generally a plurality of hours. Hardening of the moulding mixture only takes place after forming, and then a quick reaction is desirable. After hardening, the mould can be removed from the moulding box immediately, so that short cycle times can be achieved. However, to obtain good mould strength, hardening of the moulding mixture must take place uniformly within the mould. If the moulding mixture is hardened by later addition of a catalyst, the mould is gassed with the catalyst after moulding. For this, the gaseous catalyst is led through the mould. The moulding mixture hardens immediately after contact with the catalyst and can therefore be removed very quickly from the moulding box. With increasing mould size, it is more difficult to provide a sufficient amount of catalyst for hardening of the moulding mixture in all sections of the mould. The gassing times become longer, but there may nevertheless be sections of the mould that are only reached very poorly, or not at all, by the gaseous catalyst. The amount of catalyst therefore increases considerably with increasing size of the mould.

Similar difficulties arise in hot hardening processes. Here, all sections of the mould must be heated to a sufficiently high temperature. With increasing size of the mould, on the one hand, for mould hardening, it must be heated to a particular temperature for longer times. Only this can ensure that even the interior of the mould has the required strength. On the other hand, with increasing mould size, hardening also becomes very expensive with respect to equipment.

In the case of heavy castings, the weight of the cores is often around 1000 kg or more. In processes with hardening with gas or by heating, for technical reasons such large cores can only be produced with difficulty, if at all. In this case it is preferable to use cold-setting methods.

In the production of moulds for large castings, for example engine blocks of marine diesel engines or large machine parts, such as hubs of rotors for wind turbine generators, generally so-called "no-bake binders" are used, for the reasons stated. In the "no-bake process", the refractory moulding base material (e.g. sand) is often first coated with a catalyst (hardener), then the binder is added and, by mixing, is distributed uniformly on the grains of the refractory moulding base material, which are already coated with catalyst. So-called continuous mixers are often used in this process. The resultant moulding mixture can then be formed into a moulded article. As binder and catalyst are uniformly distributed in the moulding mixture, hardening takes place largely uniformly even with large moulded articles.

Alternatively, in the "no-bake process" the refractory moulding base material (e.g. sand) can first be mixed with the binder and then the hardener can be added. With this procedure, in particular in the production of moulds for large castings, owing to a partial, local excessive concentration of the hardener there may be partial setting or crosslinking of the binder, so that an inhomogeneous moulding material would be obtained.

As the catalyst (hardener) is already added to the moulding mixture before forming, hardening of the moulding mixture begins immediately after it is produced. In order to obtain a processing time that is suitable for industrial application, the components of the moulding mixture should therefore be matched with one another. Thus, the reaction rate with a given amount of the binder and of the refractory moulding base material can be influenced for example by the nature and amount of the catalyst or also by adding retarding components. Moreover, processing of the moulding mixture should take place under very controlled conditions, as the hardening rate is influenced for example by the temperature of the moulding mixture.

The "classical" no-bake binders are often based on furan resins and phenolic resins. They are often supplied as systems (kits), with one component comprising a reactive furan resin or phenolic resin and the other component comprising an acid, wherein the acid acts as catalyst for the hardening of the reactive resin component.

Furan and phenolic resins have very good decomposition properties during casting. Under the action of the heat of the molten metal, the furan or phenolic resin decomposes and the mould loses its strength. After casting, cores can therefore be poured out of cavities very easily, optionally after prior vibration of the casting.

"Furan no-bake binders" contain reactive furan resins, which regularly include furfuryl alcohol as an essential component. In conditions of acid catalysis, furfuryl alcohol can react with itself and form a homopolymer. For the production of furan no-bake binders, generally furfuryl alcohol is not used alone, instead other compounds are added to the furfuryl alcohol, which become incorporated in the resin by polymerisation. Examples of such compounds are aldehydes, such as formaldehyde or furfural, ketones, such as acetone, phenols, urea or also polyols, such as sugar alcohols or ethylene glycol. Other components that have an influence on the properties of the resin, for example its elasticity, can also be added to the resins. For example melamine can be added, to bind formaldehyde that is still free.

Furan no-bake binders are generally prepared by first producing pre-condensates in acid conditions, for example from urea, formaldehyde and furfuryl alcohol. These pre-condensates are then diluted with furfuryl alcohol.

It is also conceivable to react urea and formaldehyde on their own. This results in so-called UF resins (urea-formaldehyde resins, "aminoplasts"). These are then often diluted with furfuryl alcohol. Advantages of this manner of production are increased flexibility/variability in the product range and lower costs, as they are cold mixing processes. A disadvantage is that certain chemical and application properties cannot be achieved. Moreover, UF resins are often cloudy, so that as a rule binders produced from them are also cloudy and inhomogeneous.

Resols can also be used for producing furan no-bake binders. Resols are produced by polymerisation of mixtures of phenol and formaldehyde. These resols are then often diluted with a large amount of furfuryl alcohol.

Furan no-bake binders are regularly hardened with an acid. This acid catalyses the crosslinking of the reactive furan resin. It should be borne in mind that, depending on the type of binder, the amounts of acid should not be below certain levels, as alkaline components that may be present in the refractory moulding base material can partially neutralise the acid.

Sulphonic acids, phosphoric acid or sulphuric acid are often used as acids. In some special cases combinations of these are used, sometimes also in combination with further carboxylic acids. Moreover, certain "hardening moderators" can also be added to the furan no-bake binder.

Phosphoric acid is often used as acid catalyst for hardening in concentrated form, i.e. at concentrations of more than 70%. However, it is only suitable for the catalytic hardening of furan resins with a relatively high proportion of urea, as this substantially involves hardening of the aminoplast fraction in the furan no-bake binder. The nitrogen content of these resins is as a rule above 2.0 wt. %. Sulphuric acid, as a relatively strong acid, can be added as starter to weaker acids for the hardening of furan resins. However, an odour typical of sulphur compounds then develops during casting. Moreover, there is a risk of the cast material picking up sulphur, which affects its properties.

The choice of the acid catalyst for hardening has a considerable influence on the curing behaviour of the binder, the properties of the moulding mixture and the mould obtainable therefrom or the core obtainable therefrom. Thus, the hardening rate can be influenced by the amount and the strength of the acid. Large amounts of acid or stronger acids then lead to an increase in hardening rate. If setting is too quick, the processing time of the moulding mixture is shortened too much, so that processability is greatly impaired or processing is even no longer possible. If too much acid catalyst is used, the binder, for example a furan resin, can moreover become brittle on hardening, which has an adverse effect on mould strength. If too little acid catalyst is used, the resin is not fully hardened (or hardening takes a very long time), which leads to lower strength of the mould.

In the production of moulds, new sand is often used for the cores, whereas reprocessed moulding base material (e.g. sand) is often used for the moulds. Refractory moulding base materials that have been strengthened with furan no-bake binders can be reprocessed very well. Reprocessing is either mechanical, by mechanically abrading a skin formed from the residual binder, or by thermal treatment of the used sand. With mechanical reprocessing or with combined mechanical/thermal processes, recycle rates approaching 100% can be reached.

Phenolic resins, as the second large group of acid-catalysed hardenable no-bake binders, contain resols as the reactive resin component, i.e. phenolic resins that have been produced with a molar excess of formaldehyde. Compared with furan resins, phenolic resins display lower reactivity and require strong sulphonic acids as catalysts. Phenolic resins have a relatively high viscosity, which increases further when the resin is stored for a long time. After the phenolic no-bake binder has been applied on the refractory moulding base material, the moulding mixture should be processed as soon as possible, to avoid any impairment of the quality of the moulding mixture through premature hardening, which can lead to impairment of strength of the moulds made from the moulding mixture. When using phenolic no-bake binders, the flowability of the moulding mixture is generally poorer than a comparable moulding material produced with a furan no-bake binder. During production of the mould, the moulding mixture must therefore be compacted carefully, if high mould strength is to be achieved.

Producing and processing such a moulding mixture should take place at temperatures in the range from 15 to 35° C. If the temperature is too low, the moulding mixture cannot be processed so well, owing to the high viscosity of the phenolic no-bake resin. At temperatures above 35° C., the processing time is shorter because of premature hardening of the binder.

After casting, moulding mixtures based on phenolic no-bake binders can also be reprocessed, wherein once again mechanical or thermal or combined mechanical/thermal processes can be used.

As already explained, the acid used as catalyst in the furan or phenolic no-bake process has a very large influence on the properties of the mould. The acid must be of sufficient strength to ensure a sufficient reaction rate in mould hardening.

Hardening should be very controllable, so that it is also possible to have sufficiently long processing times. This is particularly important in the production of moulds for very large castings, assembly of which takes longer.

Furthermore, during regeneration of old moulding materials (i.e. moulding materials already used in the production of lost moulds or cores, for example used sands), the acid must not become enriched in the regenerated material. If acid is introduced into the moulding mixture via the regenerated material, this shortens the processing time and leads to impairment of the strength of the mould made from the regenerated material.

Therefore not every acid is suitable for use as catalyst in no-bake processes. Until now, toluenesulphonic acid, benzenesulphonic acid or also methanesulphonic acid and in some cases xylenesulphonic acid or cumenesulphonic acid [2(or 4)-(isopropyl)-benzenesulphonic acid] have often been used in practice, plus phosphoric acid and sulphuric acid as well.

Phosphoric acid is only suitable, as already explained, for the hardening of certain grades of furan resin. However, phosphoric acid is not suitable for the hardening of phenolic resins. As a further disadvantage, phosphoric acid has a tendency to become enriched in the regenerated material, which makes reuse of the regenerated material more difficult. During casting and in thermal regeneration, sulphuric acid leads to the emission of sulphur dioxide, which has corrosive properties, is harmful to health and presents a troublesome odour. For other disadvantages when using sulphuric acid, see below.

No-bake binders have been used for some time for producing moulds and cores for heavy and single castings. These cold-setting systems are generally reaction products of formaldehyde with furfuryl alcohol, phenol and/or urea.

These known no-bake binders have one or a plurality of the following disadvantages or undesirable properties: excessive content of furfuryl alcohol, excessive water content, excessive formaldehyde content, excessive odour, excessive ammonia content and/or excessive total nitrogen content.

U.S. Pat. No. 3,644,274 relates primarily to a no-bake process using certain mixtures of acid catalysts for hardening for furfuryl alcohol-formaldehyde-urea resins.

U.S. Pat. No. 3,216,075 describes furfuryl alcohol-formaldehyde resins, which are used there for producing foundry cores and moulds at higher temperatures, i.e. at temperatures>175° C. There, reaction products of furfuryl alcohol and formaldehyde were first produced in the presence of oxalic acid, and after distillation of water, largely anhydrous high-viscosity resins were obtained, which were then diluted with furfuryl alcohol, to establish a lower viscosity.

U.S. Pat. No. 3,806,491 relates to binders that can be used in the "no-bake" process. The binders used there comprise products from the reaction of paraformaldehyde with certain ketones in a basic environment and furfuryl alcohol and/or furan resins.

U.S. Pat. No. 5,607,986 describes heat-hardening binders for producing moulds and cores in the "warm-box" or "hot-box" process, which are based on furfuryl alcohol-formaldehyde-phenolic resins, which were produced in a basic environment at pH values in the range from 8 to 9. The binders according to U.S. Pat. No. 5,607,986 additionally contained furfuryl alcohol and polyvinyl acetate.

U.S. Pat. No. 5,491,180 describes resin binders that are suitable for use in the no-bake process. The binders used there are based on 2,5-bis(hydroxymethyl)furan or methyl or ethyl ethers of 2,5-bis(hydroxymethyl)furan, wherein the binders contain 0.5 to 30 wt. % water and regularly a high proportion of furfuryl alcohol.

EP 0 540 837 proposes low-emission, cold-setting binders based on furan resins and lignin from the Organosolv process. The furan resins described there contain a high proportion of monomeric furfuryl alcohol.

DE 198 56 778 describes cold resin binders that are obtained by reaction of an aldehyde component, a ketone component and a component consisting substantially of furfuryl alcohol.

EP 1 531 018 relates to no-bake foundry binder systems from a furan resin and certain acid hardeners. The binder systems described therein preferably comprise 60 to 80 wt. % of furfuryl alcohol.

DE 10 2008 024 727 describes certain methanesulphonic acid-containing catalyst mixtures, which are used there as hardener in the no-bake process.

U.S. 2008/0207796 discloses no-bake binders, which are substantially free from nitrogen and formaldehyde, based on monomeric furfuryl alcohol and "furan derivatives" (for example 2,5-bis(hydroxymethyl)furan or 5-hydroxymethylfurfural) and/or polyester polyols.

U.S. Pat. No. 4,176,114 A discloses a method for producing sand moulds and cores. Herein, sand is mixed with an acid-hardening resin, which comprises "high viscosity poly furfuryl alcohol". Hardening then takes place by contacting of the mixture with gaseous sulphur dioxide in the presence of an oxidising agent.

U.S. Pat. No. 5,741,914 A discloses resin-based binder compositions, which comprise reaction products of furfuryl alcohol with formaldehyde. The binder compositions sometimes comprise a weak organic acid and in some cases only a small proportion of formaldehyde.

U.S. Pat. No. 6,391,942 B1 discloses furan no-bake foundry binders and use thereof.

In particular in iron and steel casting, particularly in the casting of high-grade steels, it is desirable for the total nitrogen content to be as low as possible, because in particular a total nitrogen content of 4 wt. % or higher in a no-bake binder can lead to casting defects. In particular for use in the area of cast steel as well as grey cast iron, a no-bake binder should have a total nitrogen content that is as low as possible, because in these cases surface defects, for example so-called "pinholes" can occur as a casting defect.

There is a type of pinholes called "water-nitrogen pinholes", in which water vapour reacts with the accompanying elements of iron and nitrogen-containing components to metal oxides and nitrogen-hydrogen compounds, which diffuse into the molten metal and thus lead to the formation of micropores.

In processes for heavy castings, in addition the ammonia content must be kept as low as possible in no-bake binders for processes for heavy castings, and the use of ammonia should preferably be avoided.

A no-bake binder preferably meets a plurality of or all of the following criteria:

low viscosity good storage stability low-nitrogen or nitrogen-free binder, in particular for high-quality steel castings little odour reactive, quick-hardening binder for short forming times (making chemically aggressive hardeners or activators unnecessary)

low-sulphur or sulphur-free binder for high-quality spheroidal graphite cast iron (with possibility of a significant reduction in $SO_2$ emission during and after casting).

As a component of a moulding mixture, a no-bake binder should fulfil a plurality of or all of the following criteria:

good through-curing little addition of binder required in moulding or coremaking little emission of harmful substances during mixing, filling and compacting of the moulding mixture (should regularly be well below the permissible TLV values)

used sands that regenerate well are obtained.

During moulding, which as a rule comprises the relevant steps of mixing, filling and compacting and storage of the moulding material, among other things attention is to be paid to the key components formaldehyde and furfuryl alcohol, according to VDG [*German Foundrymen's Association*] Code of Practice R 304 (February 1998) ("Cold-curing moulding process with furan resin").

Compliance with TLV values (TLV=threshold limit value) in foundries is not always easy to achieve, as compliance with the threshold limit values requires very expensive extraction systems and filters. For example, in the area of heavy castings production it is barely possible to install and implement efficient extraction of harmful substances that are emitted.

The object to be achieved by the invention was therefore to provide a binder based on furfuryl alcohol and formaldehyde, which can be used in a no-bake process for producing cores and moulds for the foundry industry, so that during the production of moulds and cores and/or during casting, there is little emission of harmful substances, in particular with respect to furfuryl alcohol and formaldehyde and preferably also ammonia.

In a first aspect the invention therefore relates to a mixture for use as binder in the no-bake process, comprising (a) monomeric furfuryl alcohol, wherein the amount of monomeric furfuryl alcohol is at most 25 wt. %, (b) 40 wt. % or more of reaction products of formaldehyde, wherein the reaction products comprise (b-1) reaction products of formaldehyde with furfuryl alcohol and optionally other constituents, and (b-2) optionally reaction products of formaldehyde with one or a plurality of other compounds, which is not or are not furfuryl alcohol, (c) water, wherein the amount of water is at most 20 wt. %, (d) one or a plurality of organic acids with a pKa value greater than or equal to 2.5, preferably in the range from 2.75 to 6, preferably in the range from 3 to 5, at 25° C. and/or salts thereof, wherein the mixture has a content of free formaldehyde of at most 0.5 wt. %, wherein the percentages by weight are relative to the total weight of the mixture.

Surprisingly, it was found that when using reaction mixtures according to the invention (as defined below), containing a mixture according to the invention, the emission of harmful substances, in particular the emission of furfuryl alcohol and formaldehyde, during mixing, filling and compacting of the moulding material could be reduced tremendously, without any impairment with respect to the processability and the other relevant properties of a no-bake binder. Therefore a great many desirable positive properties were achieved by the mixture according to the invention. The good processability of reaction mixtures that comprise the mixtures according to the invention is based inter alia on their comparatively low viscosity (see below regarding preferred viscosities). The other relevant properties of a no-bake binder include the influence on the curing behaviour (in particular as a function of the water content, see below) and the influence on the stability of corresponding moulds or cores on spontaneous contact with molten metal (in particular in relation to the water content, see the remarks given below regarding the explosion of moulds and cores during foundry operations).

The mixtures according to the invention and the reaction mixtures according to the invention (as defined below) is also applicable in particular in the area of heavy castings production, preferably for producing moulds and cores, in particular cores, with a weight of 800 kg or more, preferably of 900 kg or more, more preferably of 1000 kg or more.

Refractory moulding base materials that have been consolidated using a mixture according to the invention in the no-bake process are reprocessable very well. This applies in particular to sand.

Furan resins are known from the prior art that are unrelated to foundry practice. The furan resins described therein are not suitable for use as no-bake binder in foundry practice (i.e. are not suitable for use in the no-bake process), as these have in particular one or a plurality of the following disadvantages: excessive viscosity, excessive water content, excessive formaldehyde content, excessive ammonia content and/or excessive total nitrogen content. Moreover, these other furan resins known from the prior art regularly do not provide acceptable curing characteristics and do not provide development of sufficient strength when used in the no-bake process.

U.S. Pat. No. 2,343,972 describes resins that are obtained by reaction of furfuryl alcohol and formaldehyde with heating in the presence of an acid such as lactic acid, formic acid or chloroacetic acid. Concrete information on the properties that are important for binders in the no-bake process is not given in U.S. Pat. No. 2,343,972.

U.S. Pat. No. 5,741,914 (and correspondingly U.S. Pat. No. 5,849,858) describes resins as binders for producing composites, which are obtained by reacting furfuryl alcohol with an excess of formaldehyde in the presence of an acid with a pKa value above about 4, wherein the molar ratio of furfuryl alcohol to formaldehyde is at least 1:2. Similar resins are disclosed in U.S. Pat. No. 5,486,557.

DE 21 26 800 (and correspondingly CA 1 200 336) describes a method for producing a composite object and suitable binders therefore, wherein the binders are high-viscosity resin-like condensation products based on furan-formaldehyde, which are diluted with water.

U.S. Pat. No. 3,816,375 (and correspondingly DE 23 02 629) describes partially prepolymerised furfuryl alcohol-aldehyde binders, wherein the aldehyde is formaldehyde and/or furfural, which are used there for forming composite materials. When the material selected for the composite material is glass fibre, according to U.S. Pat. No. 3,816,375 preferably a prepolymerised high-viscosity furfuryl alcohol-aldehyde binder is used, which is diluted with furfural. A similar system is disclosed in U.S. Pat. No. 3,594,345 (and correspondingly DE 19 27 776).

U.S. Pat. No. 2,874,148 discloses furfuryl alcohol-formaldehyde resins that are produced by reacting furfuryl alcohol with formaldehyde in the presence of sulphuric acid. The physical properties of the resins obtained according to U.S. Pat. No. 2,874,148 are very dependent on the other particular reaction conditions.

Usually a mixture according to the invention for use as binder in the no-bake process does not comprise an acid that has a pKa value below 2 at 25° C., and preferably does not comprise an acid that has a pKa value below 2.5 at 25° C. If in exceptional cases such acids are used, their maximum total amount is preferably less than 5 wt. %, relative to the total weight of the mixture. This applies to all mixtures according to the invention described below.

Usually a mixture according to the invention for use as binder in the no-bake process does not comprise any refractory granular materials. If in exceptional cases refractory granular materials are used in the mixture, their maximum total amount is preferably less than 5 wt. %, relative to the total amount of the mixture. This applies to all mixtures according to the invention described below.

Usually a mixture according to the invention is a homogeneous solution; this applies to all preferred mixtures according to the invention described below.

Preferably a mixture according to the invention contains less than 5 wt. % of monomeric furfural, preferably less than 3 wt. %, more preferably less than 1 wt. % of monomeric furfural.

Preferably the mixtures according to the invention contain less than 3 wt. % of polyvinyl acetate, preferably less than 1 wt. %, more preferably they are free from polyvinyl acetate.

Preferably a mixture according to the invention contains less than 5 wt. % of monomeric furfural and less than 3 wt. % of polyvinyl acetate.

Preferably a mixture according to the invention contains less than 1 wt. % of monomeric furfural and less than 1 wt. % of polyvinyl acetate.

Preferably the mixtures according to the invention comprise, as part of constituent (b-1), the compound 2,5-bis(hydroxymethyl)furan (BHMF), preferably in an amount of at least 2 wt. %, more preferably in an amount from 5 to 80 wt. %, particularly preferably in an amount from 10 to 70 wt. %, in particular in an amount from 20 to 60 wt. %, in each case relative to the total weight of constituent (b-1).

Preferably the mixtures according to the invention comprise, in constituent (b-1), 2,5-bis(hydroxymethyl)furan (BHMF) in an amount of at least 1 wt. %, more preferably in an amount from 5 to 40 wt. %, particularly preferably in an amount from 10 to 35 wt. %, quite particularly preferably in an amount from 15 to 30 wt. %, relative to the total weight of a mixture according to the invention.

Preferably a mixture according to the invention comprises monomeric furfuryl alcohol (constituent (a)) and 2,5-bis(hydroxymethyl)furan (BHMF) (as part of constituent (b-1)) in a weight ratio in the range from 3:1 to 1:3, preferably in the range from 2:1 to 1:2, more preferably in the range from 3:2 to 2:3, particularly preferably in the range from 5:4 to 4:5.

In constituent (b-1) of a mixture according to the invention, the proportion of "furan ring units" can be determined from the furan ring, for example by $^{13}$C-NMR.

For the case when nitrogen-containing components are present in constituent (b-2), they can be detected from the nitrogen itself. In the case of a phenolic compound as component in constituent (b-2) differentiation is also possible based on the phenolic compound (for example determination of the residual monomer content, GC-MS analysis).

Other suitable analytical methods are $^{15}$N-NMR or $^{13}$C-NMR.

The proportion of "furan ring" units can be determined by $^{13}$C-NMR. The proportion of "furan ring" units, calculated as furfuryl alcohol (C5H6O2), in the reaction product (b-1) from formaldehyde with furfuryl alcohol and optionally further constituents is preferably in the range from 60 to 96 wt. %, preferably in the range from 70 to 95 wt. %, more preferably in the range from 75 to 90 wt. %, and particularly preferably in the range from 75 to 85 wt. %, in each case relative to the total weight of constituent (b-1).

In constituent (b-2), the other compound(s) of the reaction product with formaldehyde are preferably selected from the group consisting of organic compounds that have one or a plurality of $H_2N$ groups and/or one or a plurality of HN groups, and phenolic compounds.

The particularly preferred organic compound that has one or a plurality of $H_2N$ groups is urea.

For this, the phenolic compound(s) can be reacted under acidic conditions with furfuryl alcohol and formaldehyde directly or with a furfuryl alcohol/formaldehyde pre-condensate.

The phenolic compounds are preferably phenolic compounds with 6 to 25 carbon atoms and/or one, two, three or four hydroxyl groups bound directly to an aromatic ring, preferably selected from the group consisting of phenol, optionally C1-C4-alkyl-mono- or -disubstituted dihydroxybenzenes, trihydroxybenzenes, methylphenols and bisphenols, particularly preferably selected from the group consisting of phenol, o-dihydroxybenzene, m-dihydroxybenzene (resorcinol), p-dihydroxybenzene, 5-methylresorcinol, 5-ethylresorcinol, 2,5-dimethylresorcinol, 4,5-dimethylresorcinol, 1,2,3-trihydroxybenzene, 1,3,5-trihydroxybenzene, o-cresol, m-cresol, p-cresol and bisphenol A. Phenol, resorcinol and bisphenol A are particularly preferred.

Constituent (b-2) can be for example phenol-formaldehyde resins, which are obtainable by reacting formaldehyde and phenol and optionally another component, which is not furfuryl alcohol, under alkaline conditions.

It is to be understood that a person skilled in the art can produce constituent (b-1) and—if present—constituent (b-2) of a mixture according to the invention separately and intentionally. The constituents (b-1) and (b-2) can (preferably in the proportions stated to be preferred) first be mixed together and can be incorporated together as constituent (b) or alternatively separately as (b-1) and (b-2) in a mixture according to the invention.

It is further to be understood that the constituents (a) to (d) of a mixture according to the invention can in each case be obtained or produced separately by a person skilled in the art. The constituents (a) to (d) can (preferably in the proportions stated to be preferred) be mixed one after another or simultaneously together, thereby obtaining a mixture according to the invention.

The order of the constituents (a) to (d) does not play any notable role in producing a mixture according to the invention. Preferably the constituents (a) to (d) are mixed together at a temperature in the range from 0 to 70° C., preferably at a temperature in the range from 10 to 60° C., more preferably at a temperature in the range from 15 to 50° C., for example at 18 to 25° C.

For economic grounds, however, it is regularly preferable to produce the constituents (b-1) and (b-2) by reacting furfuryl alcohol and formaldehyde in the presence of constituent (d), preferably in a one-pot reaction. The reaction is preferably carried out in such a way that the constituents (a) and (b) (i.e. constituent (b-1) and optionally constituent (b-2)) and the constituents (c) and (d) of a mixture according to the invention are obtained in the desired proportions (preferably in the proportions stated to be preferred). In such a case subsequent or separate addition of monomeric furfuryl alcohol (constituent (a)) is not necessary. Regarding this point, reference should also be made to the method of production according to the invention, described below.

The mixtures according to the invention contain water (constituent (c)). However, as water slows down the curing of the moulding mixture obtainable therefrom and is formed in the condensation reaction during preparation and additionally water is also formed as reaction product during curing, the proportion of water selected is preferably small. Preferably the proportion of water in a mixture according to the invention is less than 20 wt. %, preferably at most 15 wt. %. Preferred mixtures according to the invention contain water in an amount in the range from 5 to 15 wt. %, more preferably in an amount in the range from 7 to 14 wt. %, quite particularly preferably in an amount in the range from 8 to 13 wt. %, where the percentages by weight are relative to the total weight of the mixture according to the invention.

The comparatively low proportion of water in comparison with a large number of resin formulations from the prior art also has the effect, over and above its positive influence on the curing behaviour, that moulds or cores produced using the mixture according to the invention burst less easily in foundry operations on contact with molten metal. With higher proportions of water in mixtures of the prior art, mould bursting is often observed, and it can largely be avoided using mixtures according to the invention.

A mixture that is preferred according to the invention (as defined above) comprises (a) monomeric furfuryl alcohol, wherein the amount of furfuryl alcohol is at most 24.75 wt. %, preferably at most 24.60 wt. %, and/or (c) water, wherein the amount of water is at most 15 wt. %, wherein the percentages by weight are relative to the total weight of the mixture.

In a mixture that is preferred according to the invention the total amount of constituent (b) is preferably 45 wt. % or more, preferably 50 wt. % or more, in each case relative to the total weight of the mixture.

A preferred mixture according to the invention is characterised in that constituent (b) comprises or consists of (b-1) 40 wt. % or more, preferably 45 wt. % or more, preferably 50 wt. % or more, of reaction products of furfuryl alcohol with formaldehyde and optionally further constituents, preferably one or a plurality of further aldehydes, preferably glyoxal, and (b-2) reaction products of formaldehyde with one or a plurality of other compounds, which is not or are not furfuryl alcohol, said reaction products being different from constituent (b-1), the amount of these further reaction products is at most 15 wt. %, preferably at most 12 wt. %, preferably at most 10 wt. %, wherein the percentages by weight are relative to the total weight of the mixture.

A preferred mixture according to the invention is characterised in that the mixture has a viscosity at 20° C. of max. 300 mPas according to DIN 53019-1: 2008-09, preferably of max. 250 mPas, preferably of max. 200 mPas, more preferably of max. 150 mPas.

The viscosity is determined according to DIN 53019-1: 2008-09, i.e. according to DIN 53019-1 of September 2008, and relates to measurements at 20° C. In the context of the present text the viscosity is stated in the unit millipascal-seconds (as mPas or mPa*s). Preferably the viscosity is determined according to DIN 53019-1 with a rotary viscosimeter at 20° C., for example with a Haake rotary viscosimeter VT 550. The viscosity values determined in the context of the present invention were measured using a cylinder (spindle) SV1 and a graduated beaker (tube) SV. The rotary speed used during viscosity measurement with the rotary viscosimeter was at a viscosity of the test sample of less than 100 mPas at 20° C. and 800 rpm (revolutions per minute); at a viscosity of the test sample from 100 to 800 mPas, measurement was performed at a rotary speed of 500 rpm at 20° C.

A quite particularly preferred mixture according to the invention for use as binder in the no-bake process is a mixture comprising (a) monomeric furfuryl alcohol, wherein the amount of monomeric furfuryl alcohol is at most 25 wt. %, (b) 40 wt. % or more of reaction products of formaldehyde, wherein the reaction products comprise (b-1) reaction products of formaldehyde with furfuryl alcohol and optionally further constituents, and (b-2) optionally reaction products of formaldehyde with one or a plurality of other compounds, which is not or are not furfuryl alcohol, (c) water, wherein the amount of water is at most 15 wt. %, (d) one or a plurality of organic acids with a pKa value greater than or equal to 2.5, preferably in the range from 2.75 to 6, preferably in the range from 3 to 5, at 25° C. and/or salts thereof, wherein the mixture has a content of free formaldehyde of at most 0.5 wt. %, wherein the percentages by weight are relative to the total weight of the mixture, wherein the mixture has a viscosity at 20° C. of max. 300 mPas according to DIN 53019-1: 2008-09, preferably of max. 250 mPas, preferably of max. 200 mPas, more preferably of max. 150 mPas.

Despite a low water content of max. 15 wt. %, said mixture according to the invention has at the same time a low viscosity, which provides excellent processability of the resultant moulding mixture in foundry operations (after mixing with moulding base material). In own investigations, the preferred mixtures according to the invention proved to be advantageous, in particular owing to their good and reproducible metering in continuous mixers. In practice, for example with predetermined screw geometries (furan cold resin facilities) 35 t of sand mix or more per hour is mixed continuously. A good "atomising" of the mixture according to the invention is important here, to ensure distribution that is as uniform and homogeneous as possible in the moulding base material during the short mixing time.

Furthermore, said mixture according to the invention leads to a good flowability e.g. of a freshly produced sand mix in mould filling. During mould filling, generally mould contours and undercuts should be well filled and compacted. Binders of higher viscosity have a tendency, in comparison with the preferred mixtures according to the invention, to stopping and poor flow of the sand mix, resulting in surface casting defects owing to poorer compaction.

A preferred mixture according to the invention is characterised in that the content of free formaldehyde is at most 0.4 wt. %, preferably at most 0.3 wt. %, preferably at most 0.2 wt. %, relative to the total weight of the mixture.

Preferably, one or a plurality of organic acids with a pKa value in the range from 2.75 to 6 at 25° C., preferably in the range from 3 to 5, and/or salts thereof, are used as constituent (d).

Organic acids with a pKa value in these ranges are particularly suitable condensation catalysts for producing the reaction products of formaldehyde with furfuryl alcohol and optionally further constituents of constituent (b-1).

Citric acid, lactic acid, benzoic acid, phthalic acid, 1-malic acid, d-tartaric acid, maleic acid, glycolic acid, glyoxylic acid, 2,4-dihydroxybenzoic acid and salicylic acid are suitable, among others, as organic acids of constituent (d) of a mixture according to the invention.

Preferred organic acids of constituent (d) are selected from the group consisting of benzoic acid, lactic acid, citric acid, phthalic acid, 2,4-dihydroxybenzoic acid, salicylic acid and salts thereof, as particularly good results were achieved with these acids in the sense of the present invention, wherein particularly good results were achieved with benzoic acid, lactic acid or citric acid and the best results were achieved with benzoic acid.

The phase compatibility of benzoic acid in the mixture according to the invention proved to be particularly good in our own investigations; no crystallisation reaction was observed.

The use of other organic acids in constituent (d) is possible, but is not preferred. For example, acetic acid, propionic acid and butyric acid are acids with a strong and in some cases offensive odour. For example, succinic acid and adipic acid tend to crystallise rapidly. The presence of these other organic acids in a mixture according to the invention is therefore not preferred.

In a mixture that is preferred according to the invention the total amount of constituent (d) is preferably 0.5 to 8 wt. %, preferably 0.75 to 5 wt. %, particularly preferably 1 to 3 wt. %, in each case relative to the total weight of the mixture.

A preferred mixture according to the invention is therefore one comprising, in constituent (d), an acid or a salt selected from the group consisting of benzoic acid, lactic acid, citric acid, phthalic acid, 2,4-dihydroxybenzoic acid, salicylic acid and salts thereof. Salicylic acid is somewhat less preferred, because in some cases it has an adverse influence on the shelf life of a mixture according to the invention and in some cases a comparatively low water miscibility was found for mixtures according to the invention produced with salicylic acid.

A preferred mixture according to the invention is one that has an ammonia content of max. 1 wt. %, preferably of max. 0.5 wt. %, preferably max 0.25 wt. %, relative to the total weight of the mixture.

A preferred mixture according to the invention has a total nitrogen content of max. 4 wt. %, preferably of max. 3.5 wt. %, preferably of max. 3.0 wt. %, relative to the total weight of the mixture. This applies in particular to the mixtures described above as preferable with a particularly low water content (in particular: max. 15 wt. %) and/or an particularly low viscosity (in particular: viscosity at 20° C. of max. 300 mPas or even lower, see above).

The total nitrogen content can be determined for example by elemental analysis or by the so-called Kjeldahl method (according to DIN 16916-02, section 5.6.4), wherein elemental analysis is preferred for determining the total nitrogen content of a mixture according to the invention.

The total nitrogen contents determined in the context of the present text were determined by elemental analysis by selective CNS combustion catalysis (CNS=carbon, nitrogen, sulphur), wherein catalytic tube combustion was carried out at 1140° C. and foreign gases were separated (equipment: VARIO MAX CNS).

A preferred mixture according to the invention is a mixture whose total content of compounds with a molecular weight above 5000 dalton (g/mol) is at most 3 wt. %, preferably at most 1 wt. %, determined by gel permeation chromatography according to DIN 55672-1 (February 1995), wherein the percentages by weight are relative to the total weight of the mixture.

The molecular weights given below refer to molecular weights determined by gel permeation chromatography (GPC) according to DIN 55672-1 (February 1995), where in the present case detection is preferably performed with a UV-detector at a wavelength of 235 nm.

In a preferred mixture according to the invention the total content of compounds with a molecular weight of more than 4000 dalton (g/mol) is at most 3 wt. %, preferably at most 1 wt. %.

In a preferred mixture according to the invention the total content of compounds with a molecular weight of more than 3000 dalton (g/mol) is at most 5 wt. %, preferably at most 2 wt. %.

In a preferred mixture according to the invention, constituent (b-1) does not comprise any compounds with a molecular weight of more than 5000 dalton, and more preferably does not comprise any compounds with a molecular weight of more than 4000 dalton.

In a preferred mixture according to the invention, constituent (b-1) comprises at most 3 wt. % of compounds with a molecular weight of more than 3000 dalton.

In a preferred mixture according to the invention, constituent (b-1) comprises at most 5 wt. % of compounds with a molecular weight of more than 2000 dalton.

In a preferred mixture according to the invention, the average molecular weight $M_w$ (weight-average molecular weight) of constituent (b-1) is in the range from 200 to 600 g/mol, more preferably in the range from 225 to 500 g/mol, particularly preferably in the range from 250 to 450 g/mol, most preferably in the range from 300 to 425 g/mol.

In a preferred mixture according to the invention the ratio of the average molecular weight $M_w$ (weight-average molecular weight) to the average molecular weight $M_n$ (number-average molecular weight) of constituent (b-1) is in the range from 5:1 to 9:8, more preferably in the range from 4:1 to 6:5, particularly preferably in the range from 3:1 to 4:3, quite particularly preferably in the range from 2:1 to 3:2.

In a preferred mixture according to the invention the ratio of average molecular weight $M_w$ to average molecular weight $M_n$ of the two constituents (a) and (b-1) together is in the range from 5:1 to 9:8, more preferably in the range from 4:1 to 6:5, particularly preferably in the range from 3:1 to 4:3, quite particularly preferably in the range from 2:1 to 3:2.

The ratio of weight-average molecular weight (average molecular weight $M_w$) to number-average molecular weight (average molecular weight $M_n$) is also called the polydispersity, which is often given on GPC spectra with D as a ratio. The polydispersity is a measure of the range of a molecular weight distribution. The larger the value of D, the wider the molecular weight distribution (a discrete compound has a polydispersity of 1).

It was found in this connection that mixtures according to the invention in which constituent (b-1) or the two constituents (a) and (b-1) together have a polydispersity described above as preferable or particularly preferable, showed particularly good results and effects in the sense of the present invention.

The mixtures according to the invention can preferably contain for example one or a plurality of adhesion promoters, preferably one or a plurality of silanes.

Suitable silanes are for example aminosilanes, epoxysilanes, mercaptosilanes, hydroxysilanes and ureidosilanes, such as gamma-hydroxypropyltrimethoxysilane, gamma-aminopropyl-methyl-diethoxysilane, gamma-aminopropyltrimethoxysilane, gamma-aminopropyltriethoxysilane, 3-ureidopropyltriethoxysilane, gamma-mercaptopropyltrimethoxysilane, gamma-glycidoxypropyltrimethoxysilane, beta-(3,4-epoxycyclohexyl)trimethoxysilane, N-beta-(aminoethyl)-gamma-aminopropyltrimethoxysilane.

Gamma-aminopropylmethyldiethoxysilane (N-aminopropylmethyldiethoxysilane) are marketed under the trade names Silane 1100, Silane 1101 and Silane 1102 (technical grade) and AMEO T and gamma-aminopropyltriethoxysilane (N-aminopropyltriethoxysilane) under the names Dynasilane 1505 and 1506 (technical grade). Silanes that are obtainable under the trade names DAMO, DAMO-T and Dynasilane 1411 are also suitable.

With mixtures according to the invention containing one or a plurality of silanes, in particular one or a plurality of silanes from the group N-aminopropylmethyldiethoxysilane, N-aminoethyl-3-aminopropyltrimethoxysilane, N-aminoethyl-3-aminopropylmethyldiethoxysilane and/or N-aminopropyltriethoxysilane, particularly good results were achieved in the production of moulds or cores, in particular with N-aminopropylmethyldiethoxysilane and/or N-aminopropyltriethoxysilane.

A particularly preferred mixture according to the invention therefore comprises additionally as further constituent (e) one or a plurality of adhesion promoters, preferably selected from the group of the silanes, preferably N-aminopropylmethyldiethoxysilane, N-aminoethyl-3-aminopropyltrimethoxysilane, N-aminoethyl-3-aminopropylmethyldiethoxysilane and/or N-aminopropyltriethoxysilane, preferably in a total amount of up to 3 wt. %, preferably from 0.1 to 1 wt. %, wherein the percentages by weight are relative to the total weight of the mixture.

The mixtures according to the invention can contain further additives. Thus, they can for example contain diols or aliphatic polyols as curing moderators, which lead to a lowering of reactivity. The proportion of these curing moderators in a mixture according to the invention should not be too high, as curing moderators of this kind can in unfavourable cases lead to a decrease in mould strength. The proportion of curing moderators is therefore preferably at most 10 wt. %, preferably at most 5 wt. %, relative to the total weight of the mixture.

A particularly preferred mixture according to the invention additionally comprises one or a plurality of further constituents, selected from the group of (f) organic curing moderators, preferably selected from the group of di-, tri-, or polyols, preferably from the group of glycols with 2 to 12 carbon atoms, preferably in an amount of max. 10 wt. %, relative to the total weight of the mixture, (g) inert organic solubilisers, preferably with 1 to 6 carbon atoms, preferably selected from the group of R—OH alcohols, where R denotes a C1-C4 alkyl residue, here preferably ethanol, preferably in an amount of max. 10 wt. %, relative to the total weight of the mixture, (h) reaction products of furfuryl alcohol and one or a plurality of aldehydes with 2 or more carbon atoms, preferably reaction products of furfuryl alcohol and glyoxal, (j) organic compounds that have one or a plurality of $H_2N$ groups and/or one or a plurality of HN groups, preferably urea, (k) phenolic compounds, preferably phenolic compounds with 6 to 25 carbon atoms and/or one, two, three or four hydroxyl groups bound directly to an aromatic ring, preferably selected from the group consisting of phenol, optionally C1-C4-alkyl-mono- or -disubstituted dihydroxybenzenes, trihydroxybenzenes, methylphenols and bisphenols, particularly preferably selected from the group consisting of phenol, o-dihydroxybenzene, m-dihydroxybenzene, p-dihydroxybenzene, 5-methylresorcinol, 5-ethylresorcinol, 2,5-dimethylresorcinol, 4,5-dimethylresorcinol, 1,2,3-trihydroxybenzene, 1,3,5-trihydroxybenzene, o-cresol, m-cresol, p-cresol and bisphenol A, (m) benzyl alcohol, (n) aldehydes with 2 or more carbon atoms, preferably selected from the group consisting of acetaldehyde, propionaldehyde, butyraldehyde, acrolein, crotonaldehyde, benzaldehyde, salicylaldehyde, cinnamaldehyde, glyoxal and mixtures of these aldehydes, preferably glyoxal.

Preferred organic curing moderators of constituent (f) are glycols with 2 to 12 carbon atoms, more preferably glycols with 2 to 6 carbon atoms, with ethylene glycol, i.e. monoethylene glycol, being quite particularly preferred.

The amount of ethylene glycol is preferably at most 10 wt. %, preferably at most 5 wt. %, relative to the total weight of the mixture according to the invention.

Preferred aldehydes, which form reaction products with furfuryl alcohol according to constituent (h) of a mixture according to the invention, are acetaldehyde, propionaldehyde, butyraldehyde, acrolein, crotonaldehyde, benzaldehyde, salicylaldehyde, cinnamaldehyde, glyoxal and mixtures of these aldehydes, glyoxal once again being preferred.

The preferred aldehyde with 2 or more carbon atoms of constituent (h) and/or of constituent (n) of a mixture according to the invention is glyoxal, as it is not only readily available and is advantageous from economic standpoints, but also provides a mixture according to the invention with technical advantages. For example, even small amounts of glyoxal as constituent (n) but also reaction products of furfuryl alcohol and glyoxal as constituent (h) have a positive influence on the reactivity of a mixture according to the invention.

If a mixture according to the invention comprises constituent (n), the total amount of constituent (n) is preferably at most 5 wt. %, more preferably at most 3 wt. %, relative to the total weight of the mixture.

Preferred phenolic compounds of constituent (k) of a mixture according to the invention are phenolic compounds with 6 to 25 carbon atoms and one, two, three or four hydroxyl groups bound directly to an aromatic ring. Further preferred phenolic compounds are selected from the group consisting of phenol, optionally C1-C4-alkyl-mono- or -di-substituted dihydroxybenzenes, trihydroxybenzenes, methylphenols and bisphenols, particularly preferably selected from the group consisting of phenol, o-dihydroxybenzene, m-dihydroxybenzene (resorcinol), p-dihydroxybenzene, 5-methylresorcinol, 5-ethylresorcinol, 2,5-dimethylresorcinol, 4,5-dimethylresorcinol, 1,2,3-trihydroxybenzene, 1,3,5-trihydroxybenzene, o-cresol, m-cresol, p-cresol and bisphenol A (2,2-bis(4-hydroxyphenyl)-propane), wherein phenol, resorcinol and/or bisphenol A once again are particularly preferred.

Constituent (k) preferably comprises or consists of phenol, resorcinol and/or bisphenol A, as in particular these free phenols displayed high affinity for reaction with formaldehyde and quickly react with any formaldehyde still present, so that the emission in particular of formaldehyde can be further reduced, in particular during the curing process.

Bisphenol A is particularly advantageous in this connection, because—presumably on account of its diphenylmethane structure—after the curing of a mixture according to the invention, as a constituent of a reaction mixture according to the invention it leads to higher strength of the moulds and cores obtained. Moreover, higher thermal stability is observed, in particular during the casting process, so that a further positive effect can be achieved with respect to emission.

A preferred mixture according to the invention can additionally comprise benzyl alcohol as constituent (m), preferably in an amount of max. 15 wt. %, relative to the total weight of the mixture.

The addition of benzyl alcohol, which as constituent (m) mainly serves as solvent in a mixture according to the invention, improves the desired properties of a mixture according to the invention still further.

Among other advantages, there is very good compatibility with the other constituents of a mixture according to the invention. It was also found that there is a lowering of the viscosity, i.e. also of the viscosity value, and furthermore, the storage stability of a mixture according to the invention is further improved.

Moreover, when benzyl alcohol is used, compared with lower alcohols (in particular 1-alkanols with 1 to 4 carbon atoms, in particular methanol, ethanol or isopropanol), the flash point of a mixture according to the invention is increased and at the same time the odour is reduced. Moreover, with lower alcohols, depending on the amount used, there may be an undesirably long delay in cold curing, which is only observed to a slighter extent with benzyl alcohol.

A preferred mixture according to the invention has, at 25° C., a pH value in the range from 4 to 10, preferably in the range from 5 to 9.5.

A mixture according to the invention has, at 25° C., preferably a pH value in the range from 5 to 7 or in the range from 8 to 9.5.

The preferred pH values of a mixture according to the invention, which is usually a solution, ensure excellent storage stability.

A preferred mixture according to the invention is a mixture that is stable in storage, which preferably has a storage stability of at least 3 months at 20° C., wherein during the storage period preferably the viscosity value of the mixture at 20° C., measured according to DIN 53019-1: 2008-09, increases by at most 80%, preferably by at most 70%, preferably by at most 60%, particularly preferably by at most 50%, and preferably does not exceed 300 mPas, preferably 250 mPas, more preferably 200 mPas, particularly preferably 150 mPas, and the proportion by weight of constituent (a) decreases by at most 10%, preferably by at most 5%, relative to the initial amount of monomeric furfuryl alcohol at the start of the storage period.

A preferred mixture according to the invention comprises or consists of:

(a) monomeric furfuryl alcohol, wherein the amount of monomeric furfuryl alcohol is at most 25 wt. %, preferably at most 24.75 wt. %, (b) 40 wt. % or more of reaction products of formaldehyde, wherein the reaction products comprise (b-1) 40 wt. % or more, preferably 45 wt. % or more, of reaction products of furfuryl alcohol with formaldehyde and optionally further constituents, preferably one or a plurality of further aldehydes, here preferably glyoxal, and (b-2) reaction products of formaldehyde with one or a plurality of other compounds, which is not or are not furfuryl alcohol, said reaction products being different from constituent (b-1), wherein the amount of said further reaction products is at most 12 wt. %, preferably at most 10 wt. %, (c) water, wherein the amount of water is at most 15 wt. %, (d) one or a plurality of organic acids with a pKa value in the range from 2.75 to 6, preferably in the range from 3 to 5, at 25° C. and/or salts thereof, preferably in a total amount from 0.75 to 5 wt. %, (e) one or a plurality of adhesion promoters from the group of silanes, preferably N-aminopropylmethyldiethoxysilane, N-aminoethyl-3-aminopropyltrimethoxysilane, N-aminoethyl-3-aminopropylmethyldiethoxysilane and/or N-aminopropyltriethoxysilane, preferably in a total amount of up to 3 wt. %, preferably from 0.1 to 1 wt. %, (f) one or a plurality of organic curing moderators from the group of glycols with 2 to 12 carbon atoms, preferably in an amount of max. 10 wt. %, (g) one or a plurality of inert organic solubilisers, selected from the group of alcohols R—OH, wherein R denotes a C1-C4 alkyl residue, here preferably ethanol, (h) optionally one or a plurality of reaction products of furfuryl alcohol and one or a plurality of aldehydes with 2 or more carbon atoms, preferably reaction products of furfuryl alcohol and glyoxal, (j) optionally one or a plurality of organic compounds, which have one or a plurality of $H_2N$ groups and/or one or a plurality of HN groups, preferably urea, (k) optionally one or a plurality of phenolic compounds, preferably phenolic compounds with 6 to 25 carbon atoms and/or one, two, three or four hydroxyl groups bound directly to an aromatic ring, preferably selected from the group consisting of phenol, optionally C1-C4-alkyl-mono- or -disubstituted dihydroxbenzenes, trihydroxybenzenes, methylphenols and bisphenols, particularly preferably selected from the group consisting of phenol, o-dihydroxybenzene, m-dihydroxybenzene, p-dihydroxybenzene, 5-methylresoreinol, 5-ethylresorcinol, 2,5-dimethylresorcinol, 4,5-dimethylresorcinol, 1,2,3-trihydroxybenzene, 1,3,5-trihydroxybenzene, o-cresol, m-cresol, p-cresol and bisphenol A, (n) optionally glyoxal, and optionally free formaldehyde in an amount of at most 0.5 wt. %, wherein the percentages by weight are relative to the total weight of the mixture.

Another preferred mixture according to the invention comprises or consists of:

(a) monomeric furfuryl alcohol, wherein the amount of monomeric furfuryl alcohol is at most 24.75 wt. %, preferably at most 24.60 wt. %, (b) 45 wt. % or more of reaction products of formaldehyde, wherein the reaction products comprise (b-1) 45 wt. % or more, preferably 50 wt. % or more, of reaction products of furfuryl alcohol with formaldehyde and optionally further constituents, preferably one or a plurality of further aldehydes, here preferably glyoxal, and (b-2) reaction products of formaldehyde with one or a plurality of other compounds, which is not or are not furfuryl alcohol, said reaction products being different from constituent (b-1), wherein the amount of said further reaction products is at most 12 wt. %, preferably at most 10 wt. %, (c) water, wherein the amount of water is at most 15 wt. %, preferably in an amount from 5 to 15 wt. %, (d) one or a plurality of organic acids with a pKa value in the range from 3 to 5 at 25° C. and/or salts thereof, preferably in an amount from 1 to 4 wt. %, (e) one or a plurality of adhesion promoters from the group of silanes, preferably N-aminopropylmethyldiethoxysilane, N-aminoethyl-3-aminopropyltrimethoxysilane, N-aminoethyl-3-aminopropylmethyldiethoxysilane and/or N-aminopropyltriethoxysilane, preferably in a total amount from 0.1 to 1 wt. %, (f) ethylene glycol in an amount of max. 5 wt. %, preferably in an amount from 1 to 4 wt. %, (g) ethanol in an amount of max. 5 wt. %, preferably in an amount from 1 to 4.5 wt. %, (h) optionally one or a plurality of reaction products of furfuryl alcohol and one or a plurality of aldehydes with 2 or more carbon atoms, preferably reaction products of furfuryl alcohol and glyoxal, (n) optionally glyoxal, and either constituent (j) or constituent (k)

(j) one or a plurality of organic compounds, which have one or a plurality of $H_2N$ groups and/or one or a plurality of HN groups, preferably urea, (k) optionally one or a plurality of phenolic compounds, preferably phenolic compounds with 6 to 25 carbon atoms and/or one, two, three or four hydroxyl groups bound directly to an aromatic ring, preferably selected from the group consisting of phenol, optionally C1-C4-alkyl-mono- or -disubstituted dihydroxybenzenes, trihydroxybenzenes, methylphenols and bisphenols, particularly preferably selected from the group consisting of phenol, o-dihydroxybenzene, m-dihydroxybenzene, p-dihydroxybenzene, 5-methylresorcinol, 5-ethylresorcinol, 2, 5-dimethylresorcinol, 4,5-dimethylresorcinol, 1,2,3-trihydroxybenzene, 1,3,5-trihydroxybenzene, o-cresol, m-cresol, p-cresol and bisphenol A, and optionally free formaldehyde in an amount of at most 0.5 wt. %, wherein the percentages by weight are relative to the total weight of the mixture.

A particularly preferred mixture according to the invention comprises or consists of:

(a) monomeric furfuryl alcohol, wherein the amount of monomeric furfuryl alcohol is at most 24.60 wt. %, (b) 45 wt. % or more of reaction products of formaldehyde, wherein the reaction products comprise (b-1) 45 wt. % or more, preferably 50 wt. % or more, of reaction products of furfuryl alcohol with formaldehyde and optionally further constituents, preferably one or a plurality of further aldehydes, here preferably glyoxal, and (b-2) reaction products of formaldehyde with one or a plurality of other compounds, which is not or are not furfuryl alcohol, said reaction products being different from constituent (b-1), wherein the amount of these further reaction products is at most 12 wt. %, preferably at most 10 wt. %, (c) water, wherein the amount of water is at most 15 wt. %, preferably in an amount from 7 to 14 wt. %, (d) one or a plurality of organic acids with a pKa value in the range from 3 to 5 at 25° C. and/or salts thereof in an amount from 1 to 4 wt. %, wherein the organic acid is selected from the group consisting of benzoic acid, lactic acid and citric acid, (e) N-aminopropylmethyldiethoxysilane and/or N-aminopropyltriethoxysilane, preferably in a total amount from 0.1 to 1 wt. %, (f) ethylene glycol in an amount of max. 5 wt. %, preferably in an amount from 1 to 4 wt. %, (g) ethanol in an amount of max. 5 wt. %, preferably in an amount from 1 to 4.5 wt. %, (h) optionally one or a plurality of reaction products of furfuryl alcohol and one or a plurality of aldehydes with 2 or more carbon atoms, preferably reaction products of furfuryl alcohol and glyoxal, (n) optionally glyoxal, and either constituent (j) or constituent (k)

(j) urea, (k) phenol, resorcinol and/or bisphenol A, and optionally free formaldehyde in an amount of at most 0.5 wt. %, wherein the percentages by weight are relative to the total weight of the mixture.

The invention further relates to a reaction mixture comprising (i) a mixture according to the invention, preferably in one of the embodiments characterised as preferable, (ii) an acid, wherein the acid has a pKa value of less than 2 at 25° C., preferably of less than 1.5, preferably of less than 1.

Herein, the reaction mixture preferably has a content of free formaldehyde of max. 0.4 wt. %, wherein the percentages by weight are relative to the total weight of the reaction mixture minus the total weight of refractory granular materials in the reaction mixture.

Constituent (ii) is also called acid hardener. The acid hardener enables a mixture according to the invention to be cured at low temperatures, typically at ambient temperature. The amount of constituent (ii) used is preferably such that curing of the mixture according to the invention already occurs at low temperatures, typically at ambient temperature, in particular at 25° C.

Preferably the total amount of acid with a pKa of less than 2 at 25° C. used is such that the pH of the resultant reaction mixture is less than 3, preferably even less than 1. The acid hardener advantageously already brings about curing of the mixture according to the invention at 25° C.

Constituent (ii) of a reaction mixture according to the invention preferably comprises or preferably consists of organic sulphonic acids. Besides aromatic sulphonic acids, such as benzenesulphonic acid, toluenesulphonic acids, xylenesulphonic acids or cumenesulphonic acid [2(or 4-(isopropyl)-benzenesulphonic acid], methanesulphonic acid and ethanesulphonic acid are also preferred. The organic sulphonic acids are readily available and have a sufficiently high acid strength to achieve the desired curing of a mixture according to the invention in the no-bake process. In the context of the present invention, the best results were achieved with p-toluenesulphonic acid.

A reaction mixture is preferred according to the invention, wherein the acid of component (ii) is selected from the group of organic acids, preferably the organic sulphonic acids, preferably selected from the group consisting of benzenesulphonic acid, toluenesulphonic acids, xylenesulphonic acids, cumenesulphonic acid [2(or 4)-(isopropyl)-benzenesulphonic acid] and methanesulphonic acid; p-toluenesulphonic acid is in particular preferred.

Preferably the reaction mixture comprises (i) no sulphuric acid or (ii) sulphuric acid in an amount of max. 1 wt. %, preferably max. 0.5 wt. %, wherein the percentages by weight are relative to the total weight of the reaction mixture minus the total weight of (optionally present) refractory granular materials in the reaction mixture. Preferably the reaction mixture does not comprise any phosphoric acid and does not comprise any hydrochloric acid; particularly preferably the reaction mixture according to the invention does not comprise any mineral acids at all. In the case of sulphuric acid, the strength of the acid is in some cases problematic. According to experience, binders that are only cured with sulphuric acid display a "spontaneously" produced polymer network with inevitably more defects. Furthermore, the material-dependent higher proportion of sulphur means that there is massive sulphurisation of the return sand. This massive sulphurisation produces casting and structural defects and also has an extremely unpleasant smell (foul odour). It has been shown that the sulphur from sulphuric acid is reduced during the process to sulphur-containing compounds, which remain in the sand system.

However, aromatic sulphonic acids have very good miscibility with resins (possess good phase compatibility). As curing takes place, it is more ordered, more homogeneous, more complete and more controllable, compared with sulphuric acid. Furthermore, a proportion of the organically bound sulphur evaporates as $SO_2$ from the moulding material during casting. Because of this, there is less sulphurisation. In handling, the less corrosive sulphonic acids also have to be assessed positively, in comparison with sulphuric acid (there is a beneficial influence on tool life).

Preferably, in a reaction mixture according to the invention, acid with a pKa of less than 2 at 25° C. is used in a total amount in the range from 10 to 80 wt. %, preferably from 15 to 70 wt. %, preferably from 20 to 60 wt. %, particularly preferably from 25 to 50 wt. %, in each case relative to the total weight of formaldehyde and the constituents (a), (b), (c), (d), (e), (f), (g), (h), (j), (k) and (n) of the mixture according to the invention (constituent (i)).

The total proportion of acid or acids with a pKa of less than 2 at 25° C. in a reaction mixture according to the invention is preferably in the range from 9 to 45 wt. %, preferably from 13 to 41 wt. %, preferably from 16 to 38 wt. %, particularly preferably from 20 to 33 wt. %, relative to the total weight of the reaction mixture according to the invention minus the total weight of any refractory granular materials present.

A reaction mixture is preferred according to the invention that additionally comprises (iii) one or a plurality of refractory granular materials, preferably sand, preferably in an amount of 80 wt. % or more, preferably 95 wt. % or more, relative to the total weight of the reaction mixture.

When a reaction mixture according to the invention comprises, in addition to a mixture according to the invention (constituent (i)), an acid hardener (constituent (ii)) and a refractory granular material (constituent (iii)), it is a moulding mixture.

Reaction mixtures according to the invention are preferred that do not comprise sulphur dioxide or do not comprise any peroxide (in particular methylethyl ketone peroxide), preferably those that comprise neither sulphur dioxide nor a peroxide (in particular methylethyl ketone peroxide).

Refractory moulding base materials that have been solidified in the no-bake process using a reaction mixture according to the invention are reprocessable very well. This applies in particular to sand.

A reaction mixture according to the invention preferably comprises sand, preferably with a grain size in the range from 0.063 to 2 mm, preferably with a grain size in the range from 0.1 to 1 mm.

A reaction mixture according to the invention preferably comprises 80 wt. % or more of constituent (iii), preferably 95 wt. % or more, relative to the total weight of the reaction mixture (i.e. the moulding mixture).

Constituent (iii) preferably comprises or consists of sand, preferably aluminosilicate sand, feldspar sand and/or quartz sand. Particularly preferably constituent (iii) comprises quartz sand, even more preferably constituent (iii) consists of quartz sand.

The invention further relates to a method for producing a mixture according to the invention, preferably in one of the embodiments characterised as preferable or characterised as particularly preferable, with the following step:

(S-1) reaction of furfuryl alcohol with formaldehyde and optionally further constituents in the presence of one or a plurality of organic acids with a pKa value greater than or equal to 2.5, preferably in the range from 2.75 to 6, preferably in the range from 3 to 5, at 25° C. and/or salts thereof, wherein the molar ratio of the total amount of furfuryl alcohol used to the total amount of formaldehyde used is greater than or equal to 1, preferably is in the range from 5:1 to 1.1:1, preferably in the range from 3:1 to 1.25:1, more preferably in the range from 2:1 to 3:2.

Formaldehyde can be used both in monomeric form, for example in the form of a formalin solution, and in the form of its polymers, such as trioxane or paraformaldehyde, the use of paraformaldehyde being preferred according to the invention.

Additionally, apart from formaldehyde, other aldehydes can also be used. Suitable aldehydes are for example acetaldehyde, propionaldehyde, butyraldehyde, acrolein, crotonaldehyde, benzaldehyde, salicylaldehyde, cinnamaldehyde, glyoxal and mixtures of these aldehydes.

Particularly preferred organic acids with a pKa value in the range from 3 to 5 at 25° C. are selected from the group consisting of benzoic acid, lactic acid, citric acid, phthalic acid, 2,4-dihydroxybenzoic acid and salicylic acid, wherein benzoic acid, lactic acid, and citric acid are more preferred, and benzoic acid is most preferred.

In step (S-1), a pH value is preferably established in the range from 2.8 to 5, preferably in the range from 3.5 to 4.5, in each case measured at 20° C.

In a preferred method according to the invention, step (S-1) takes place at a temperature in the range from 90 to 160° C., preferably at a temperature in the range from 100 to 150° C.

A preferred method according to the invention comprises the following further steps:

(S-2) preheating of the (first) reaction mixture resulting from step (S-1) to a temperature in the range from 40 to 90° C., preferably in the range from 50 to 80° C., (S-3) optionally adjustment of the desired pH value with an inorganic base, preferably with an alkali metal hydroxide, preferably NaOH and/or KOH, (S-4) addition of one or a plurality of compounds that can react with any formaldehyde still present (or addition of one or a plurality of compounds for reaction with any formaldehyde still present), wherein these compounds are preferably selected from the group of organic compounds with one or a plurality of $H_2N$ and/or HN groups and/or the group of phenolic compounds, (S-5) preheating of the reaction mixture resulting from the preceding steps to a temperature in the range from 10 to 50° C., preferably in the range from 15 to 40° C., (S-6) optionally addition of further constituents, preferably one, a plurality of or all of the constituents (e), (f), (g), (h), (j), (k), (m) and (n) as defined above for a mixture according to the invention, preferably in one of the embodiments characterised as preferable.

In a preferred method according to the invention the total amount of furfuryl alcohol used is at least 50 wt. %, preferably at least 55 wt. %, and is preferably in the range from 60 to 75 wt. %, more preferably in the range from 62 to 72 wt. %, wherein the percentages by weight are relative to the total weight of the resultant mixture according to the invention.

A preferred mixture according to the invention (as defined above), preferably in one of the embodiments characterised as preferable, is a mixture that is producible by a method according to the invention, preferably in one of the embodiments characterised as preferable.

The invention also relates to a method of production of a mould or a core, preferably a no-bake mould or a no-bake core for producing metal objects, comprising the step:

curing, preferably acid-catalysed curing, of a mixture according to the invention, preferably in one of the embodiments characterised as preferable, or curing of a reaction mixture according to the invention, preferably in one of the embodiments characterised as preferable, wherein curing preferably takes place at a temperature below 60° C., preferably in the range from 0 to 50° C., more preferably in the range from 10 to 40° C., particularly preferably in the range from 15 to 30° C.

In a preferred embodiment for carrying out the no-bake process, the refractory moulding base material according to the invention (constituent (iii) of a reaction mixture according to the invention) is first coated with the acid hardener (constituent (ii) of a reaction mixture according to the invention). Then the binder (i.e. a mixture according to the invention; constituent (i) of a reaction mixture according to the invention) is added and, by mixing, is uniformly distributed on the grains of the refractory moulding base material already coated with the catalyst. The moulding mixture can then be formed into a moulded article. Because the binder and the acid hardener are uniformly distributed in the moulding mixture, curing takes place substantially uniformly even with large moulded articles.

In a preferred method according to the invention, curing preferably takes place in the absence of sulphur dioxide. Preferably, for curing a mixture according to the invention, a reaction mixture according to the invention is produced, which then hardens directly. The statements regarding the reaction mixture according to the invention apply correspondingly to the method according to the invention.

In the method according to the invention for producing cores and moulds for the foundry industry, preferably a moulding mixture is used that is suitable in particular for producing large moulds and cores, wherein these moulds and cores display reduced emission of harmful compounds during casting.

The invention also relates to a mould or a core for producing metal objects, obtainable by curing a reaction mixture according to the invention, preferably in one of the embodiments characterised as preferable.

In another aspect, the invention relates to the use of a mixture according to the invention, preferably in one of the embodiments characterised as preferable, as a cold-setting binder, preferably as a no-bake binder in foundry practice, in particular in the production of metal objects by a casting process, wherein the curing of the binder preferably takes place without the use of gaseous sulphur dioxide.

In another aspect, the invention relates to the use of a mixture according to the invention or of a reaction mixture, preferably in each case in one of the embodiments characterised as preferable, in a no-bake process for producing metal objects, preferably in a no-bake process in which no gaseous sulphur dioxide is used for curing, preferably in a no-bake process without a gassing step.

The invention further relates to a kit, comprising as a first component, a mixture according to the invention, preferably in one of the embodiments characterised as preferable, as a second component, an aqueous solution of an acid, wherein the acid has a pKa value below 2 at 25° C.

The invention is explained in more detail below with examples.

EXAMPLES

Unless stated otherwise, all figures given refer to weight. Abbreviations used: FA=furfuryl alcohol, AI=assessment index.

The chemical and physical parameters of the resins are compared in Table 1 below. The values given correspond to average values, which are typical for the respective binder.

The no-bake binders not according to the invention, with the designations "KH-Ref1" and "KH-Ref2", are commercially available products.

TABLE 1

| | KH-Ref1 (not according to the invention) | KH-Y (according to the invention) | KH-Ref2 (not according to the invention) |
|---|---|---|---|
| Total amount of FA used | 87 wt. % | 67 wt. % | 75 wt. % |
| Content of monomeric FA | 87 wt. % | 24.5 wt. % | 63 wt. % |
| Total nitrogen content | 1.05 wt. % | 2.85 wt. % | 3.5 wt. % |
| Water content | 10 wt. % | 11 wt. % | 10 wt. % |
| Free formaldehyde | 0.15 wt. % | 0.15 wt. % | 0.06 wt. % |
| Density at 20° C. | 1.130 g/cm$^3$ | 1.185 g/cm$^3$ | 1.160 g/cm$^3$ |
| Dyn. viscosity at 20° C. | 10 mPa * s | 65 mPa * s | 20 mPa * s |
| Appearance | light brown, cloudy | dark brown, clear | dark brown, clear |

The no-bake binder KH-Ref2, not according to the invention, also investigated here for comparative purposes, had the following composition:

| | |
|---|---|
| Cold resin TN-X | 56.0 wt. % |
| Content of monomeric FA | 41.3 wt. % |
| Water | 2.5 wt. % |
| N-aminopropylmethyldiethoxysilane | 0.2 wt. % |

These constituents of the no-bake binder KH-Ref2 were introduced into a reactor with stirring, and the constituents were mixed for 15 minutes.

Production of the Cold Resin TN-X:

Furfuryl alcohol (60.30 wt. %), paraformaldehyde 91% (15.88 wt. %), formic acid 85% (0.60 wt. %), urea (12.59 wt. %), water (3.56 wt. %), ethanol (4.95 wt. %), ammonia 25% in water (2.12 wt. %).

The reactor content is stirred throughout the process. A reactor is loaded with 489.9 kg furfuryl alcohol, 63.0 kg urea, 158.8 kg paraformaldehyde 91%, 35.6 kg water and 49.5 kg ethanol and they are mixed thoroughly. Then 4.8 kg formic acid 85% is added and the resultant mixture is heated to 90° C. At time intervals of about 30 minutes, a further 62.9 kg urea is added gradually at 90° C. Then this reaction mixture is cooled a little and 113.1 kg furfuryl alcohol is added. After further cooling to 50° C., finally a pH in the range from 8.1 to 8.8 is established by adding 25% ammonia in water. The resultant product is designated here as mixture TN-X, not according to the invention.

Data for the cold resin TN-X: water content: 13.5 wt. %, total nitrogen content: 6.2 wt. %, formaldehyde content: 0.1 wt. %, viscosity at 20° C.: 95 mPas.

Production of the No-Bake Binder KH—Y According to the Invention:

Furfuryl alcohol (66.98 wt. %), paraformaldehyde 91% (12.38 wt. %), benzoic acid (1.56 wt. %), urea (6.07 wt. %), water (6.94 wt. %), ethanol (2.98 wt. %), monoethylene glycol (1.99 wt. %), N-aminopropyltriethoxysilane (Dynasilane 1506) (0.40 wt. %), sodium hydroxide solution 33% in water (0.70 wt. %).

The reactor content is stirred throughout the process. A reactor is loaded with 223.2 kg furfuryl alcohol and 5.2 kg benzoic acid and they are mixed thoroughly (pH: 3.7-4.2) and then 123.8 kg paraformaldehyde is added. Then it is heated within 30-60 minutes to 100 to 110° C. and this temperature is maintained for 60 minutes. At this temperature, two further portions of furfuryl alcohol and benzoic acid are added to the reaction mixture with a time interval. Then the temperature is raised to about 135° C. and the reaction mixture is heated under reflux (duration: 3 to 5 hours, the reflux temperature decreases slowly and continuously to approx. 125° C.). Then the resultant reaction mixture is cooled quickly, 60.7 kg urea is added and it is cooled further. At a temperature of 60° C., 4.0 kg of sodium hydroxide solution (33% in water) is added, establishing a pH value in the range from 5.5-6.0 (measured at 20° C.). After the reaction mixture has cooled further to about 30° C., 69.4 kg water, 29.8 kg ethanol and 19.9 kg monoethylene glycol and 4.0 kg Dynasilane 1506 are added and mixed. Optionally, finally the pH value of the reaction mixture is adjusted to 5.5-6.5 with max. 3.0 kg sodium hydroxide solution (33% in water). The resultant product is designated herein as mixture KH-Y according to the invention.

Bending Strengths and Setting Behaviour

The respective bending strength values were determined according to VDG Code of Practice P 72 (October 1999) ("Testing of cold-setting, synthetic resin-bonded moist moulding materials with hardener added").

The moulding mixture was produced in a laboratory mixer (BOSCH). For this, first the parts by weight of acid hardener given in Table 2 were added in each case to 100 parts by weight of quartz sand H32 (Frechen Quartz Works) and mixed for 30 seconds. Then the parts by weight of binder shown in Table 2 were added and mixed for a further 45 seconds. The resultant mixture was produced at room temperature (18-22° C.) and a relative humidity (RH) of the air of 20-55%. The temperature of the sand was 18-22° C.

Then the moulding mixture was placed by hand in the test bar mould and was compacted with a hand rammer.

Test bars of rectangular parallelepiped shape with the dimensions 220 mm×22.36 mm×22.36 mm, so-called Georg-Fischer test bars, were produced as test specimens.

For determination of the through-curing time, the moulding mixture is compacted with a hand rammer in a mould (beaker), height 80 mm and diameter 80 mm. The surface is checked at specified time intervals with a test nail. When the test nail no longer penetrates into the core surface, this represents the through-curing time.

For determining the processing and curing time of the moulding mixture, the setting behaviour was observed with a Georg-Fischer test bar, with the test pin according to VDG P 72.

The respective bending strength values were determined according to the aforementioned VDG-Code of Practice P 72. For determination of the bending strengths, the test bars were placed in a Georg-Fischer strength tester, equipped with a three-point bending device (DISA-Industrie AG, Schaffhausen, C H) and the force causing breakage of the test bar was measured.

The bending strengths were after one hour, after two hours, after four hours and after 24 h after producing the moulding mixture to be tested (storage of the cores after removal from the mould, in each case at room temperature 18-22° C., RH 20-55%).

Test series were conducted with the no-bake binder KH-Ref2 (not according to the invention) and two test series with the no-bake binder KH—Y (according to the invention), in each case with two different parts by weight of.

The results of the respective strength tests are presented in Table 2 (Table 2a and 2b) as the mean value of two measurements.

In the first test series, in each case separately, 1 part by weight (corresponding to 1 wt. %, relative to the amount of sand used) of no-bake binder KH-Ref2 (not according to the invention) and KH—Y (according to the invention) was processed with 0.5 part by weight of a 65 wt. % solution of p-toluenesulphonic acid in water (corresponding to 0.325 part by weight of p-toluenesulphonic acid) into a moulding mixture.

In the second test series, in each case separately, 1 part by weight (corresponding to 1 wt. %, relative to the amount of sand used) of no-bake binder KH-Ref2 (not according to the invention) and KH—Y (according to the invention) was processed with 0.4 part by weight of a 65 wt. % solution of p-toluenesulphonic acid in water (corresponding to 0.26 part by weight of p-toluenesulphonic acid) into a moulding mixture.

Abbreviations Used:

PT=processing time in minutes

CT=curing time in minutes (100 g)

TC=through-curing time in minutes

VISC=viscosity in mPas at 20° C.

BS1, BS2, BS4, BS24=bending strength after 1, 2, 4 or 24 hours (stated in each case in N/cm$^2$)

TABLE 2a

Setting behaviour and bending strengths when using 0.325 part by weight of the acid hardener p-toluenesulphonic acid

| Binder | PT | CT | TC | BS1 | BS2 | BS4 | BS24 |
|---|---|---|---|---|---|---|---|
| KH-Ref2 | 16 | 24 | 42 | 180 | 400 | 430 | 500 |
| KH-Y | 15 | 23 | 41 | 160 | 350 | 450 | 570 |

TABLE 2b

Setting behaviour and bending strengths when using 0.26 part by weight of the acid hardener p-toluenesulphonic acid

| Binder | PT | CT | TC | BS1 | BS2 | BS4 | BS24 |
|---|---|---|---|---|---|---|---|
| KH-Ref2 | 25 | 35 | 63 | 140 | 335 | 360 | 460 |
| KH-Y | 24 | 33 | 68 | 85 | 310 | 335 | 435 |

Emission Measurements in Mixing, Filling, and Compacting, and Result of Casting

The moulding mixtures described in Table 3 were processed into moulds and iron or steel casting was performed with both moulds. The measured harmful emissions in mixing, filling, and compacting are shown in Table 4. The result of casting was defect-free in both cases.

TABLE 3

Composition of moulding mixtures

| | Moulding mixture 1 (not according to the invention) | Moulding mixture 2 (according to the invention) |
|---|---|---|
| No-bake regenerated material | 100 parts by weight | 100 parts by weight |
| p-Toluenesulphonic acid (65% in water) | 0.3 part by weight | 0.3 part by weight |
| KH-Y (according to the invention) | | 1.0 part by weight |
| KH-Ref1 (not according to the invention) | 1.0 part by weight | |

TABLE 4

Results of measurement of harmful emissions in mixing, filling, and compacting

| | Moulding mixture 1 (not according to the invention) | Moulding mixture 2 (according to the invention) |
|---|---|---|
| Furfuryl alcohol | 33.00 mg/m$^3$ | 10.77 mg/m$^3$ |
| Formaldehyde | 0.222 mg/m$^3$ | 0.049 mg/m$^3$ |
| AI TLV | 0.822 | 0.325 |
| AI Others | 0.628 | 0.160 |
| AI total | 1.450 | 0.485 |

The TLV values taken as a basis were the threshold limit values according to Technical Rules for Hazardous Substances (Technische Regel für Gefahrstoffe, TRGS) 900 Edition January 2006 as amended June 2010 and TRGS 402, Edition January 2010, if no corresponding limits are published in TRGS 900.

The assessment indices AI TLV were determined according to TRGS 402 clause 5.2. The assessment indices AI Others were determined according to TRGS 402 clause 5.3. TRGS 402 in the edition of January 2010 was taken as the basis.

AI total=AI TLV+AI Others. This index should not exceed the limit of 1.

The mixtures according to the invention permit compliance with the limit AI total.

Investigations of Storage Stability

The storage stability involved storage for a period of 6 months at a constant temperature of 20-22° C. and investigation at monthly intervals. For this, the viscosity of the cold resin KH—Y according to the invention was measured and the application properties of a corresponding moulding mixture were determined (as described above).

For further investigation of the application properties, first a moulding mixture was produced. First, 0.5 part by weight of a 65 wt. % solution of p-toluenesulphonic acid in water was added to 100 parts by weight of quartz sand H32 (Frechen Quartz Works) and mixed for 30 seconds. Then 1 part by weight of binder KH—Y was added and mixed for a further 45 seconds. The resultant moulding mixture was produced at room temperature (20-22° C.) and relative humidity (RH) of 40-55%. The temperature of the sand was 20-22° C.

TABLE 5

Measurements for the storage stability of the cold resin KH-Y according to the invention

| Storage time | VISC | PT | CT | BS1 | BS2 | BS4 | BS24 |
|---|---|---|---|---|---|---|---|
| 0 month | 52 | 15 | 22 | 105 | 345 | 435 | 460 |
| 1 month | 60 | 10 | 14 | 210 | 420 | 540 | 495 |
| 2 months | 67 | 12 | 16 | 140 | 325 | 460 | 550 |
| 3 months | 69 | 14 | 19 | 125 | 295 | 490 | 500 |
| 4 months | 71 | 13 | 18 | 120 | 380 | 480 | 520 |
| 5 months | 99 | 11 | 16 | 100 | 290 | 430 | 430 |
| 6 months | 109 | 13 | 18 | 150 | 255 | 410 | 435 |

TABLE 6

Chemical and physical parameters of the no-bake binder KH-Y2 according to the invention

| | KH-Y2 (according to the invention) |
|---|---|
| Total amount of FA used | 70.18 wt. % |
| Content of monomeric FA | 24.1 wt. % |
| Total nitrogen content | 0.75 wt. % |
| Water content | 10.5 wt. % |
| Free formaldehyde | 0.2 wt. % |
| Density at 20° C. | 1.185 g/cm$^3$ |
| Dyn. viscosity at 20° C. | 70 mPa * s |
| Appearance | dark brown, clear |

Mixture KH—Y2 according to the invention has a very low total nitrogen content, so that this no-bake binder according to the invention is particularly suitable for iron and steel casting, in particular for the casting of stainless steel.

Production of the No-Bake Binder KH—Y2 According to the Invention:

Furfuryl alcohol (70.18 wt. %), paraformaldehyde 91% (12.03 wt. %), benzoic acid (1.64 wt. %), bisphenol A (2.75 wt. %), urea (1.72 wt. %), water (5.14 wt. %), ethanol (3.12 wt. %), monoethylene glycol (1.00 wt. %), N-aminopropyltriethoxysilane (Dynasilane 1505) (0.40 wt. %) potassium hydroxide solution 45% in water (2.02 wt. %).

The reactor contents are stirred throughout the process. In a reactor, 234.0 kg furfuryl alcohol and 5.5 kg benzoic acid are mixed thoroughly (pH value: 3.7-4.2) and then 120.3 kg paraformaldehyde is added. It is then heated within 30-60 minutes to 100-110° C. and this temperature is maintained for 60 minutes. At this temperature, two further portions of furfuryl alcohol and benzoic acid are added to the reaction mixture with a time interval. Then the temperature is raised to about 135° C. and the reaction mixture is heated under reflux (duration: 3 to 5 hours, during which the reflux temperature decreases slowly and continuously to approx. 125° C.). Then the resultant reaction mixture is cooled a little, 27.50 kg bisphenol A is added and it is cooled further. At a temperature of 80° C., 20.2 kg potassium hydroxide solution (45% in water) is added and it is stirred for about one more hour. After the reaction mixture has cooled further to about 60° C., 31.2 kg ethanol and 17.2 kg urea are added. After the reaction mixture has cooled further to about 35° C., finally 51.4 kg water, 10.0 kg monoethylene glycol and 4.0 kg Dynasilane 1505 are added and mixed. The resultant product is designated herein as mixture KH—Y2 according to the invention.

As in the first test series described above, correspondingly 1 part by weight (corresponding to 1 wt. %, relative to the amount of sand used) of no-bake binder KH—Y2 according to the invention was processed with 0.5 part by weight of a 65 wt. % solution of p-toluenesulphonic acid in water (corresponding to 0.325 part by weight of p-toluenesulphonic acid) into a moulding mixture.

With this moulding mixture, the bending strengths and the setting behaviour were determined, according to the test conditions described above and according to the details given above.

TABLE 6a

Setting behaviour and bending strengths of the mixture KH-Y2 according to the invention, using 0.325 part by weight of the acid hardener p-toluenesulphonic acid

| Binder | PT | CT | TC | BS1 | BS2 | BS4 | BS24 |
|---|---|---|---|---|---|---|---|
| KH-Y2 | 9 | 15 | 41 | 165 | 320 | 380 | 525 |

The invention claimed is:

1. A binder mixture for a no-bake process, comprising (a) monomeric furfuryl alcohol, wherein the amount of monomeric furfuryl alcohol is at most 25 wt. %, (b) 45 wt. % or more of reaction products of formaldehyde, wherein the reaction products comprise (b-1) reaction products of formaldehyde with furfuryl alcohol and optionally further constituents, and (b-2) optionally reaction products of formaldehyde with one or a plurality of other compounds, which is not or are not furfuryl alcohol, (c) water, wherein the amount of water is at most 20 wt. %, (d) one or a plurality of organic acids with a pKa value greater than or equal to 2.5 at 25° C. and/or salts thereof, wherein the mixture has a content of free formaldehyde of at most 0.5 wt. %, the percentages by weight being relative to the total weight of the mixture, and wherein the one or a plurality of organic acids and/or salts thereof is selected from the group consisting of benzoic acid, lactic acid, citric acid, phthalic acid, 2,4-dihydroxybenzoic acid, salicylic acid and salts thereof.

2. The binder mixture for a no-bake process according to claim 1, comprising (a) monomeric furfuryl alcohol, wherein the amount of furfuryl alcohol is at most 24.75 wt. %, and/or (c) water, wherein the amount of water is at most 15 wt. %, wherein the percentages by weight are relative to the total weight of the mixture.

3. The binder mixture for a no-bake process according to claim 1, wherein the amount of constituent (b) is 50 wt. % or more, wherein the percentages by weight are relative to the total weight of the mixture.

4. The binder mixture for a no-bake process according to claim 1, wherein constituent (b) comprises (b-1) 50 wt. % or more, of reaction products of furfuryl alcohol with formaldehyde and optionally further constituents, (b-2) reaction products of formaldehyde with one or a plurality of other compounds, which is not or are not furfuryl alcohol, said reaction products being different from constituent (b-1), wherein the amount of these further reaction products is at most 15 wt. %, wherein the percentages by weight are relative to the total weight of the mixture.

5. The binder mixture for a no-bake process according to claim 1, wherein the content of free formaldehyde is at most 0.4 wt. %, wherein the percentages by weight are relative to the total weight of the mixture.

6. The binder mixture for a no-bake process according to claim 1, wherein the ammonia content is at most 1 wt. %, wherein the percentages by weight are relative to the total weight of the mixture.

7. The binder mixture for a no-bake process according to claim 1, wherein the total nitrogen content is at most 4 wt. %, wherein the percentages by weight are relative to the total weight of the mixture.

8. The binder mixture for a no-bake process according to claim 1, wherein constituent (b-1) comprises 2,5-bis(hydroxymethyl)furan (BHMF) in an amount of at least 1 wt. %, relative to the total weight of a mixture according to the invention.

9. The binder mixture for a no-bake process according to claim 8, wherein the weight ratio of constituent (a) and 2,5-bis(hydroxymethyl)furan (BHMF) of constituent (b-1) is in the range from 3:1 to 1:3.

10. The binder mixture for a no-bake process according to claim 1, wherein the total content of compounds with a molecular weight above 5000 dalton (g/mol) is at most 3 wt. %, determined by gel permeation chromatography according to DIN 55672-1 (February 1995), relative to the total weight of the mixture.

11. The binder mixture for a no-bake process according to claim 1, wherein the ratio of weight average molecular weight $M_w$ to number average molecular weight $M_n$ of constituent (b-1) is in the range from 5:1 to 9:8.

12. The binder mixture for a no-bake process according to claim 1, additionally comprising as further constituent (e) one or a plurality of adhesion promoters selected from the group of silanes, N-aminopropylmethyldiethoxysilane, N-aminoethyl-3-aminopropyltrimethoxysilane, N-aminoethyl-3-aminopropylmethyldiethoxysilane and/or N-aminopropyltriethoxysilane, in a total amount of up to 3 wt. %, wherein the percentages by weight are relative to the total weight of the mixture.

13. The binder mixture for a no-bake process according to claim 1, additionally comprising one or a plurality of further constituents, selected from the group of (f) organic curing moderators, selected from the group of glycols with 2 to 12 carbon atoms, in an amount of up to 10 wt. %, relative to the total weight of the mixture, (g) inert organic solubilisers, selected from the group of alcohols R—OH, wherein R denotes a C1-C4 alkyl residue, (h) reaction products of furfuryl alcohol and one or a plurality of aldehydes with 2 or more carbon atoms, (j) organic compounds that have one or a plurality of $H_2N$ groups and/or one or a plurality of HN groups, (k) phenolic compounds, with 6 to 25 carbon atoms and/or one, two, three or four hydroxyl groups bound directly to an aromatic ring, (m) benzyl alcohol, (n) aldehydes with 2 or more carbon atoms selected from the group consisting of acetaldehyde, propionaldehyde, butyraldehyde, acrolein, crotonaldehyde, benzaldehyde, salicylaldehyde, cinnamaldehyde, glyoxal and mixtures of these aldehydes.

14. The binder mixture for a no-bake process according to claim 1, wherein the pH of the mixture at 25° C. is in the range from 5 to 9.5.

15. The binder mixture for a no-bake process according to claim 1, wherein the mixture is a mixture that is stable in storage, which has a storage stability of at least 3 months at 20° C., wherein during the storage period the viscosity value of the mixture at 20° C., measured according to DIN 53019-1: 2008-09, increases by at most 80%, and the proportion by weight of constituent (a) decreases by at most 10% relative to the initial amount of monomeric furfuryl alcohol at the start of the storage period.

16. The binder mixture for a no-bake process according to claim 1, further comprising methanol as an inert organic solubiliser.

17. The binder mixture for a no-bake process according to claim 1, that is produced by a method including the following step:

(S-1) reacting a furfuryl alcohol with formaldehyde and optionally further constituents in the presence of one or a plurality of organic acids with a pKa value greater than or equal to 2.5 at 25° C. and/or salts thereof, wherein the molar ratio of the total amount of furfuryl alcohol used to the total amount of formaldehyde used is greater than or equal to 1.

18. Reaction mixture, comprising (i) a mixture according to claim 1;

(ii) an acid, wherein the acid has a pKa value of less than 2 at 25° C., wherein the reaction mixture comprises a content of free formaldehyde of max. 0.4 wt. %, and wherein the percentages by weight are relative to the total weight of the reaction mixture.

19. Reaction mixture according to claim 18, wherein the reaction mixture comprises no sulphuric acid or comprises sulphuric acid in an amount of max. 1 wt. %, wherein the percentages by weight are relative to the total weight of the reaction mixture minus the total weight of refractory granular materials in the reaction mixture.

20. Reaction mixture according to claim 18, wherein the acid of component (ii) is selected from the group of organic acids.

21. Reaction mixture according to claim 1, additionally comprising (iii) one or a plurality of refractory granular materials in an amount of 80 wt. % or more relative to the total weight of the reaction mixture.

22. Reaction mixture according to claim 1, wherein the mixture does not contain sulphur dioxide, a peroxide, or both sulphur dioxide and a peroxide.

23. Method of preparing a mixture according to claim 1, with the following step:

(S-1) reaction of furfuryl alcohol with formaldehyde and optionally further constituents in the presence of one or a plurality of organic acids with a pKa value greater than or equal to 2.5 at 25° C. and/or salts thereof wherein the molar ratio of the total amount of furfuryl alcohol used to the total amount of formaldehyde used is greater than or equal to 1.

24. Method according to claim 23, wherein step (S-1) takes place at a temperature in the range from 90 to 160° C.

25. Method according to claim 23, with the following further steps:

(S-2) preheating of the reaction mixture resulting from step (S-I) to a temperature in the range from 40 to 90° C.

(S-3) optionally adjustment of the desired pH value with an inorganic base, (S-4) addition of one or a plurality of compounds that can react with any formaldehyde still present (S-5) preheating of the reaction mixture resulting from the preceding steps to a temperature in the range from 10 to 50° C.

(S-6) optionally addition of further constituents.

26. Method according to claim 23, wherein the total amount of furfuryl alcohol used is at least 50 wt. % wherein the percentages by weight are relative to the total weight of the resultant mixture.

27. Method of producing a mould or a core comprising the steps: Curing of a mixture according to claim 1, or a reaction mixture comprising the mixture according to claim 1 and an acid, wherein the acid has a pKa value of less than 2 at 25° C., wherein the reaction mixture comprises a content of free formaldehyde of max. 0.4 wt. %, and wherein the percentages by weight are relative to the total weight of the reaction mixture; wherein curing preferably takes place at a temperature below 60° C.

28. Kit, comprising as a first component, a mixture according to claim 1, as a second component, an aqueous solution of an acid, wherein the acid has a pKa value of less than 2 at 25° C.

* * * * *